United States Patent [19]

Birdy et al.

[11] Patent Number: 4,478,537

[45] Date of Patent: Oct. 23, 1984

[54] ARCTIC CAISSON SYSTEM

[75] Inventors: Jal N. Birdy, Kingwood; Dilipkumar N. Bhula, Houston, both of Tex.

[73] Assignee: Brian Watt Associates, Inc., Houston, Tex.

[21] Appl. No.: 394,783

[22] Filed: Jul. 2, 1982

[51] Int. Cl.[3] ..... E02B 15/02

[52] U.S. Cl. ..... 405/217; 405/203; 405/210

[58] Field of Search ..... 405/203–210, 405/217, 211; 175/5–7

[56] References Cited

U.S. PATENT DOCUMENTS

| | | | |
|---|---|---|---|
| 2,895,301 | 7/1959 | Casagrande et al. | 405/208 |
| 3,021,680 | 2/1962 | Hayward | 405/207 |
| 3,779,024 | 12/1973 | Greve | 405/210 |
| 3,793,842 | 2/1974 | Lacroix | 405/210 |
| 3,952,527 | 4/1976 | Vinieratos et al. | 405/217 |
| 3,972,199 | 8/1976 | Hudson et al. | 405/217 |
| 3,990,254 | 11/1976 | Mo | 405/203 |
| 4,188,157 | 2/1980 | Vigarder | 405/207 X |

*Primary Examiner*—Dennis L. Taylor

*Attorney, Agent, or Firm*—Pravel, Gambrell, Hewitt, Kirk & Kimball

[57] ABSTRACT

A marine structure comprising a cellular caisson which forms a stable platform for carrying out a variety of offshore operations in the arctic and sub-arctic regions is provided. The structure may be grounded on reasonably level sea bottom with a minimum of sea bed preparation in shallow water or mounted upon a previously prepared berm. Resistance to local ice forces is provided by the hexagonal cellular arrangement of the perimeter and interior walls which make up the cellular caisson. Global foundation resistance is obtained by introducing a suitable quantity of ballast into the structure. The design allows clusters of two or more structures to be grouped together to augment the offshore installation and to permit the offshore installation to be developed in stages at the site.

15 Claims, 9 Drawing Figures

ARCTIC CAISSON SYSTEM

BACKGROUND OF THE INVENTION

The present invention relates to marine structures which provide a platform for carrying out operations in arctic and sub-arctic regions. The marine structure of the present invention is particularly well suited for conducting exploration drilling in areas such as the Alaskan Beaufort Sea and serves equally well for supporting production equipment, liquification plants, gas compression plants, crude oil storage and offshore loading facilities in this and other such regions. Most exploration drilling in the Alaskan Beaufort Sea has occurred close to shore and often behind barrier islands in shallow water near gravel sources so that gravel islands may be utilized to serve as an exploration drilling platform. The need to use such gravel island platforms severely limits the development and exploration of areas which are further offshore and removed from convenient sources of gravel and where more severe environmental conditions are encountered.

Since in most arctic and sub-arctic locations, only about two months of acceptable weather for construction per year are available, structures designed for use in these regions should ideally require a minimum amount of construction effort at the job site. Structures adapted for use in ice laden environments must be designed to safely resist substantial ice forces encountered even when the structures are mounted upon weak bottom soils or silts. It is also desirable for such structures, particularly those used for exploration drilling, to be able to relocate from one drilling site to another on a year round basis in the event that the first drilling site proves unsuccessful. It is further desirable to provide a structure which may be developed in stages so that exploration drilling may proceed without the associated platforms need to support production equipment which may be added once the well proves to be successful.

SUMMARY OF THE INVENTION

The present invention provides an economical, adaptable and stable platform structure for use in marine environments which is suitable for carrying out a variety of offshore operations in the severe arctic and sub-arctic regions, in areas removed from convenient gravel sources.

The structure of the present invention is a cellular caisson unit including a base slab, an outer ice resisting perimeter wall, a top slab, an ice deflector positioned above the perimeter wall, and an interior made up of honeycombed, vertical walled circular units which provide load bearing strength as well as storage space for ballast, and various other production products. The interior cellular arrangement is designed to provide an efficient system to effectively distribute the environmental loading imposed by ice floes and other ice features. The ice deflector positioned above the perimeter wall deflects any ice which may be advancing and received by the perimeter walls thereby preventing the ice from coming aboard the main deck of the marine structure. The structure is designed as a gravity structure and will resist the ice loading by virtue of its own weight plus the weight of any ballast that may be introduced within it.

The structure may be built in concrete, reinforced concrete, post-tensioned concrete, a combination of reinforced post-tensioned concrete or other similar cementitious material as is dictated by the loading requirements imposed by the environment. The structure may be towed under its own buoyancy and installed on relatively uniform sea beds by ballasting with sea water. A substantial amount of plant and equipment can be preinstalled on the structure before the tow, thus reducing the need to carry out offshore operations in the short weather window. Once installed, the structure can be ballasted further with sea water, other heavier materials or both depending on the foundation soils and environmental conditions. In weaker clay or silty soils, foundation drains may be installed in the structure to dissipate excess pore water pressures in the soil and thus accelerate the improvement of the foundation resistance.

The high redundancy of the cellular structure enhances survivability in the event local damage to a particular cell or group of cells is incurred due to unusual and unforeseen loading from the ice environment. Furthermore, due to the high aspect ratio of the structure, i.e., the ratio of its depth to its width, the structure possesses substantial rigidity and can tolerate uneven foundation support without distress. It is anticipated, however, that some preparation of the sea bed will in most cases be carried out to provide a reasonably level sea bottom for installation of the structure. This preparation will typically consist of a shallow sand pad over the existing sea bottom. The structure may be readily used in water depths ranging between twenty feet and sixty feet with only a minimum amount of sea bed preparation. For deeper waters, a sand or gravel berm will be required to raise the sea bed to the founding level.

Due to the unique design of the structure, in most cases, only sea water ballast will be required to achieve foundation resistance to environmental loads thus making deballasting and movement of the structure to another location a relatively easy task even during the ice season. Thus the structure of the present invention provides a relatively rigid, load bearing platform for carrying out a variety of production operations in sub-arctic and arctic environments which may be towed into position and ballasted at the job site. The unique design of the structure distributes the environmental loading and provides a stable and reusable platform which is adapted to be used singly or as part of a staged assembly of platform members.

DESCRIPTION OF THE PREFERRED EMBODIMENT

Figure 1:
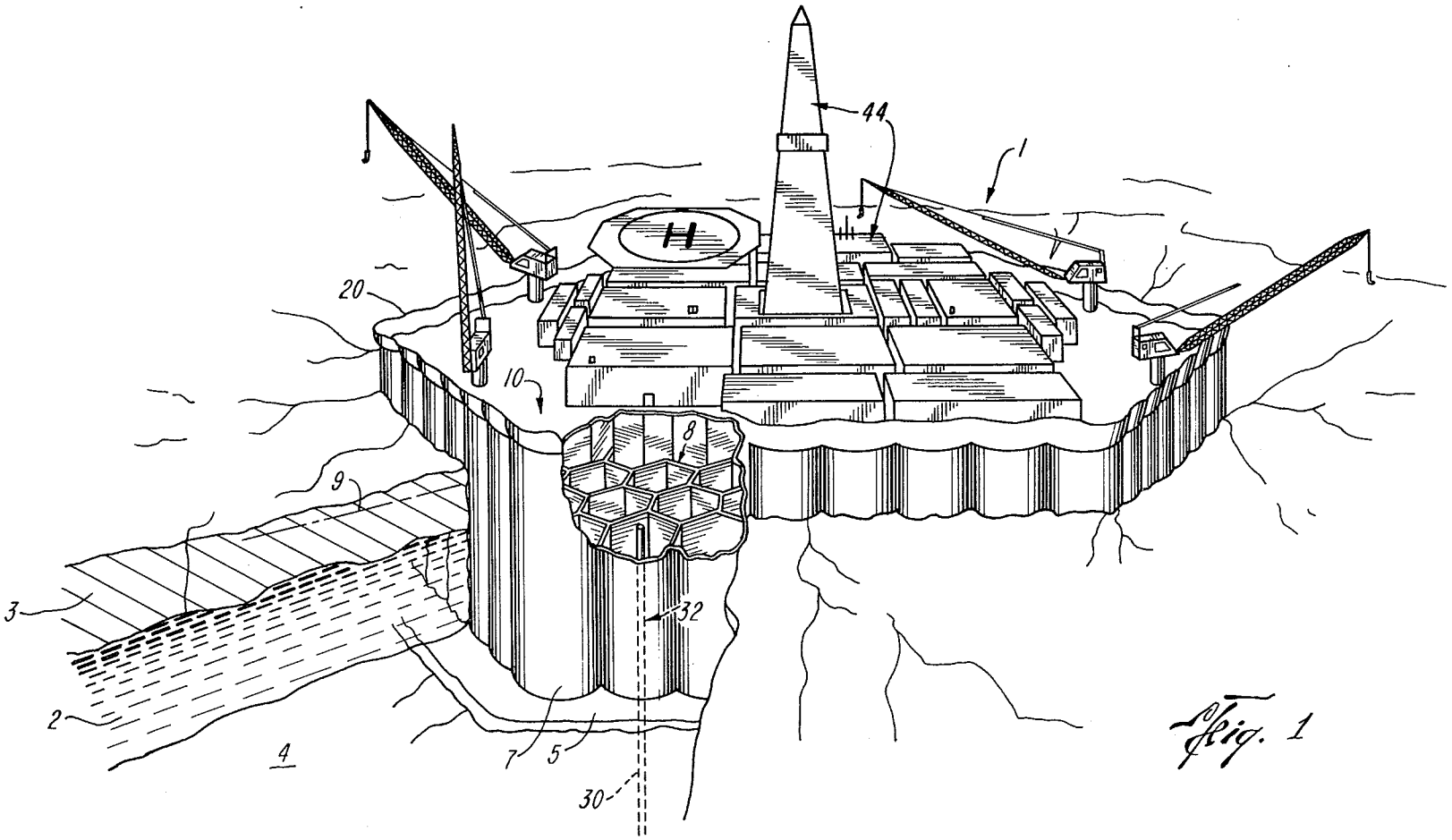
FIG. 1 is a perspective view of an installed marine structure according to the present invention.

In the drawings, a marine structure 1 is located in a body of water 2, the marine structure being particularly designed for installation in arctic and sub-arctic waters upon which ice features 3 may be formed. The entire structure 1 may be constructed in a less hostile environment, towed to location under its own buoyancy, and installed on location by sea water ballasting. A substantial quantity of equipment and supplies may be installed on the structure before it is towed and installed on location. The structure 1 is held in place on the sea bottom 4 by its own weight plus the weight of any ballast, as will be discussed in more detail below, added to the structure. If the topography and strength of the underwater sea bottom 4 permits, the structure may be placed directly on the bottom without prior preparation. In other applications, it may be placed upon a prepared sand bed 5 previously deposited on sea bottom 4. Thus positioned, the structure 1 provides a stable platform from which a variety of offshore operations may be performed. These operations may include, but are not limited to, exploration drilling, production drilling, hydrocarbon production, gas compression, waterflood operations, enhanced hydrocarbon recovery, gas liquefaction, mineral ore extraction and processing, coal handling, storage of materials and equipment, offshore loading of tankers and other vessels, and offshore housing of personnel.

Figure 6:
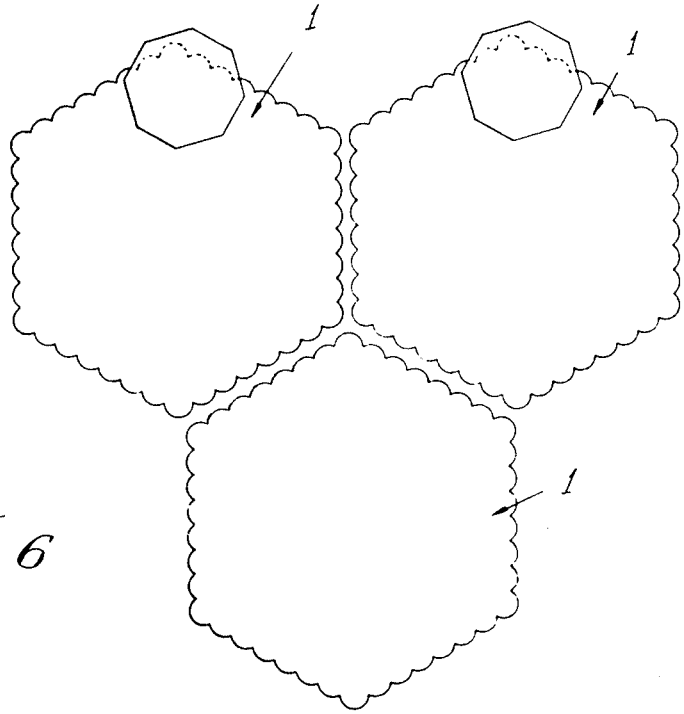
FIG. 6 is a schematic plan view of an assembly of more than one structure of the present invention combined at a single location.

The structure 1 is adapted to function in a range of water depths and be refloated and moved from one location to another by removing or adding ballast as required. Furthermore, two or more such structures 1 may be combined to augment or alter functions carried out from a single structure 1 as shown in FIG. 6.

Figure 2:
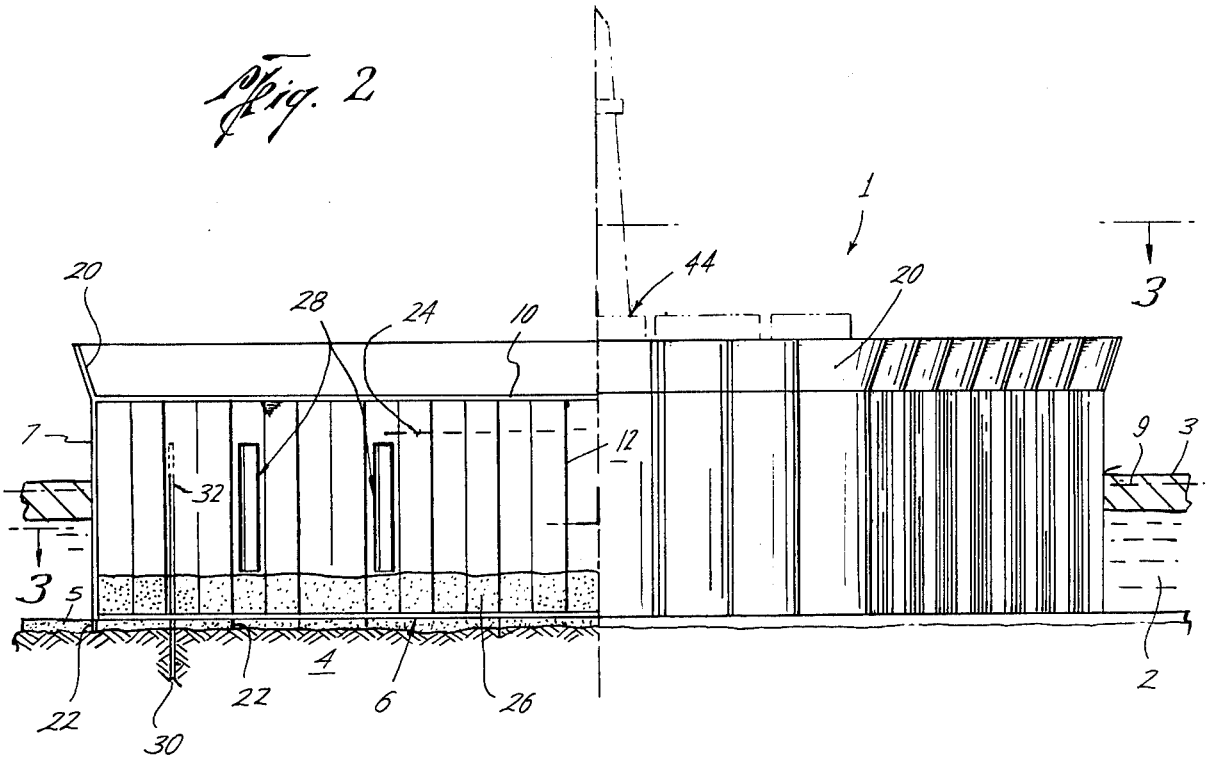
FIG. 2 is a front elevational view in partial cross-section of the structure shown in FIG. 1.
Figure 3:
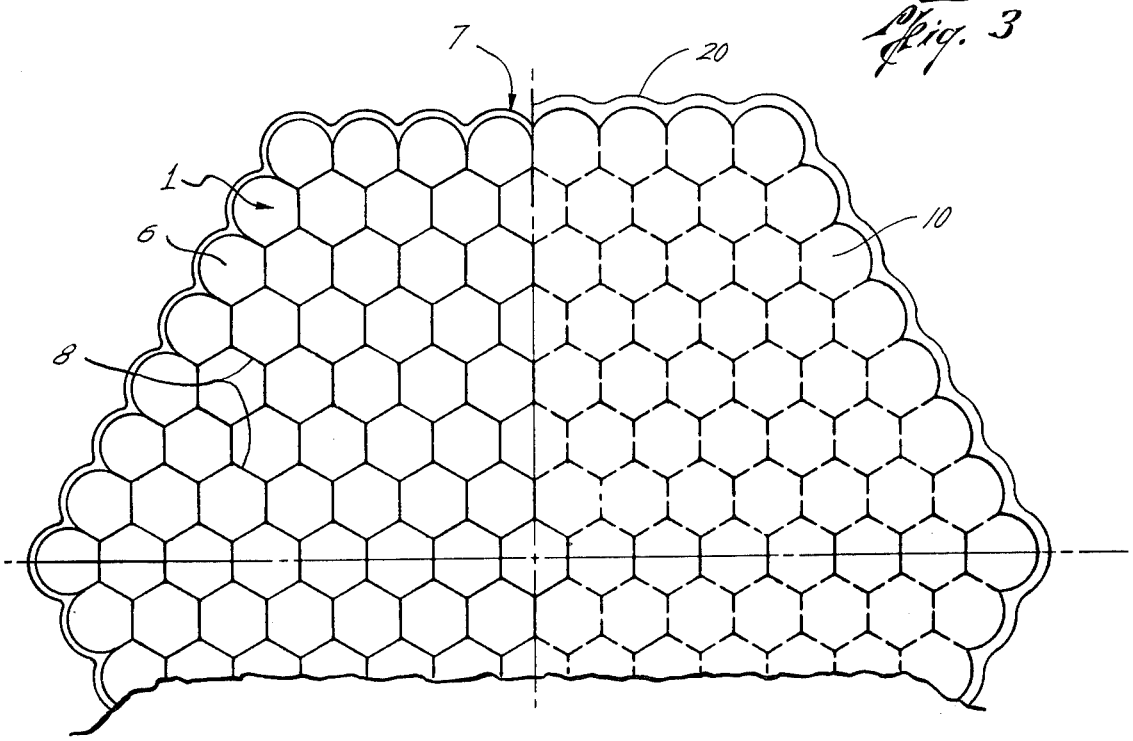
FIG. 3 is a plan view in partial cross-section of a portion of the structure shown in FIGS. 1 and 2, cross-section being taken substantially upon line 3—3 of FIG. 2.

In the preferred embodiment, the structure 1 is formed of reinforced concrete, post-tensioned concrete or a combination of the two or other suitable cementitous materials. Structure 1 includes a bottom slab 6 surmounted by vertical perimeter wall 7 and interior vertical cell walls 8 formed in a hexagonal pattern. Perimeter wall 7 and interior walls 8 extend above nominal sea water level 9 and support top slab 10 as a load bearing platform (FIGS. 1–3). The hexagonal pattern of the cell wall structures 8 enables concentrated ice forces applied to the perimeter wall 7 to be efficiently distributed to the body of the structure and permits the interior cell walls 8 to be made relatively thin as compared to the perimeter wall 7 (FIG. 3). Furthermore, the hexagonal pattern of cell walls 8 divides the interior in separate compartments within the structure which provide a high degree of redundancy and survivability in the event of damage to the outer skin since the loss of ballast is then confined to a limited number of cells.

Figure 4:
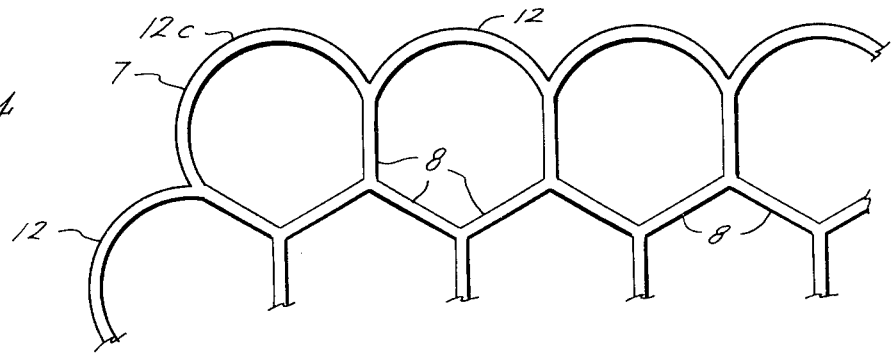
FIG. 4 is a partial cross-sectional plan view of a corner of the structure shown in FIGS. 1 and 2 which includes a portion of the perimeter walls of the structure.
Figure 5:
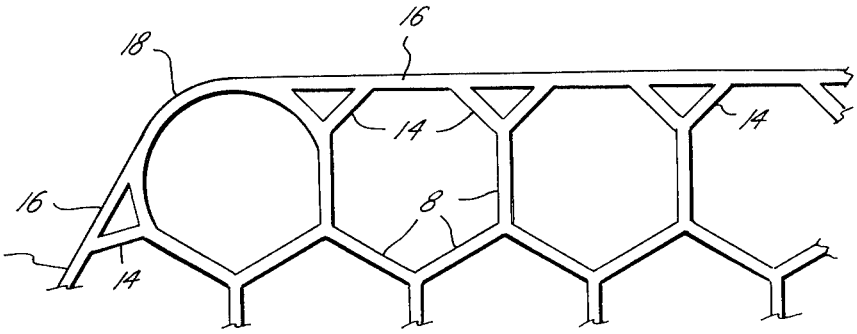
FIG. 5 is a partial cross-sectional plan view of another embodiment of a corner of the structure shown in FIGS. 1 and 2 including a portion of the perimeter wall.

Perimeter wall 7 may be formed of a plurality of straight facets, circular arcs, or a combination of the two, the latter two alternative embodiments being illustrated in FIGS. 4 and 5, respectively. Referring now to FIG. 4, perimeter wall 7 is formed of arcuate wall sections 12 of equal radius which may vary given a particular application. Arcuate wall section **12*c* which forms the portions of the perimeter wall located at the corner of the overall hexagonal shape of the structure 1 subtends a greater arc than those arcuate sections 12 in the non-corner positions so that lines drawn tangent to the perimeter of structure 1** form a substantially regular hexagonal pattern.

Alternatively, the perimeter wall 7 may be formed of a combination of planar wall sections 16, arcuate wall sections 18 located at each hexagonal corner of structure 1 and connecting wall segments 14. Connecting segments 14 join the perimeter 7 to the interior structure formed by walls 8. In either of the embodiments shown in FIG. 4 or FIG. 5, the interior cellular arrangement coupled with the perimeter connecting structures are designed to provide an efficient system to effectively distribute environmental loading imposed by ice floes or other ice features so that the forces are absorbed predominantly by compressive forces induced in the walls. In this manner the primary strength of the concrete is utilized to maximum advantage. To further enhance the structures durability, a hard exterior skin 19 formed of metal, hardened thermoplastics or other hardened materials may be provided, on the perimeter walls 7 to resist the abrasive action of ice features 3.

The perimeter wall 7 and cell walls 8 are surmounted by a top slab 10 which is integral with the walls 7 and 8 and together with the bottom slab 6 provides structural rigidity to the structure 1. Perimeter wall 7 is further surmounted by an upwardly and outwardly sloping ice deflector 20 (FIGS. 1 and 2) which serves to deflect ice features 3 and water spray away from the top slab 10 of the structure 1.

Preferably the structure 1 is installed on a substantially level granular surface on the sea bottom but because it possesses subtantial rigidity due to its celluar configuration, it can tolerate without detracting from its performance a landing on two or three highpoints. The base slab 6 is designed to have sufficient strength to tolerate local contact stresses which are substantially greater than those which would result if the structure 1 were to be in uniform contact over its entire base area. Skirt walls 22 (FIGS 1 and 9) are adjoined to base slab 6 and extend vertically beneath selected sections of perimeter wall 7 and interior cell walls 8. Skirt walls 22 may be constructed of concrete and formed integral with base slab 6 or may be constructed of steel and suitably connected to base slab 6 to provide increased resistance to the sliding or lateral displacement forces acting upon the structure from moving ice features 3. Skirt walls 22 may also be used to contain compressed air or other gases introduced under base slab 6 to reduce the towing draft of the structure 1 and facilitate movement of the structure from one point to another. Further they help prevent soil scouring from under the base of the structure 1.

In order to provide adequate resistance to sliding across the sea bottom, the interior cavities of structure 1 formed by interior walls 8 are partially filled with sea water ballast 24 (FIG. 2). A satisfactory ballast level typically falls between the level of the outside sea water 9 and the underside of top slab 10 depending upon the strength of the foundation soils and the magnitude of the environmental forces encountered at the particular job site. If other ballasting is required, the sea water ballast 24 may be supplemented by adding solid granular ballast 26 in selected cells formed by interior walls 8. Open passageways 28 are formed in selected interior walls 8 to provide fluid communication between interior cells used for sea water ballasting to reduce the quantity of pipe work and equipment required for placing and removing ballast from the structure. The sea water ballast water 24 is heated by equipment housed on or contained within the structure 1 to prevent the water from freezing during the cold weather. In the event such heating equipment should fail in cold weather, a small portion of the sea water ballast 24 is drained from the interior cells to provide adequate room for ice expansion so that forces on the interior cell walls 8 are minimized.

In operation, selected cells formed of interior walls 8 may be maintained dry or provided with partial ballast only to act as moonpools for drilling operations, to provide communications between equipment on top slab 10 and sea bottom 4, for storage of materials and equipment, or for other reasons. In the case when the cells formed by interior walls 8 serve a moonpools, they will provide continuously isolated passages which, in the event of accidental well blow-out help prevent damage from spreading to the remainder of the structure 1. These moonpools will also be large enough to enable installation of sub-mudline well head caissons by either drilling or jacking techniques.

Figure 9:
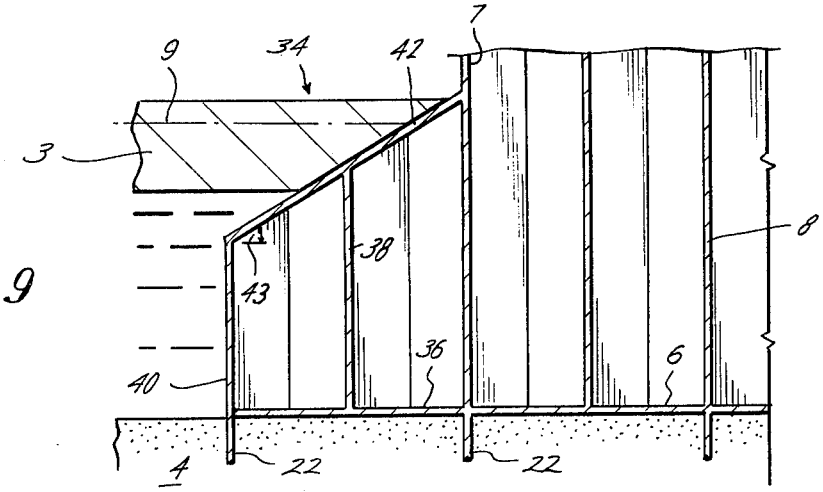
FIG. 9 is a vertical cross-sectional view of a portion of one embodiment of the structure of the present invention.

In areas where the structure 1 is required to be placed upon a sea bottom comprised of a relatively thick layer of weak, silty or clayey material, foundation drains 30 (FIGS. 1 and 2) are installed from the structure through sleeves 32 associated with selected interior walls 8. Foundation drains 30 are adapted to relieve the pore water pressure in the foundation's soil and accelerate the consolidation process thus improving its strength. Drains 30 may be installed using a rig mounted either above or below top slab 10 immediately above the selected sleeve 32.

Where sea bottom conditions are particularly weak or shallower drafts are required, an extension assembly 34 is formed on the lower section of the structure 1 as shown in FIG. 9. This extension may be formed of one or more rows of cells of lesser height than those which form the main body of the structure 1 formed around the entire perimeter of the structure 1 or at selected sections thereof. In these applications, an extension base slab 36 formed as a continuation of structure base slab 6 is provided and additional cell structures are formed of vertical interior walls 38, vertical external walls 40, and inclined top 42. The height of the structural extension may vary from slightly above the level of slab member 36 to a height slightly less than the height of the main structure 1. The angle of inclination 43 of top 42 may vary from zero degrees to ninety degrees depending upon the height of external wall 40.

Figure 7:
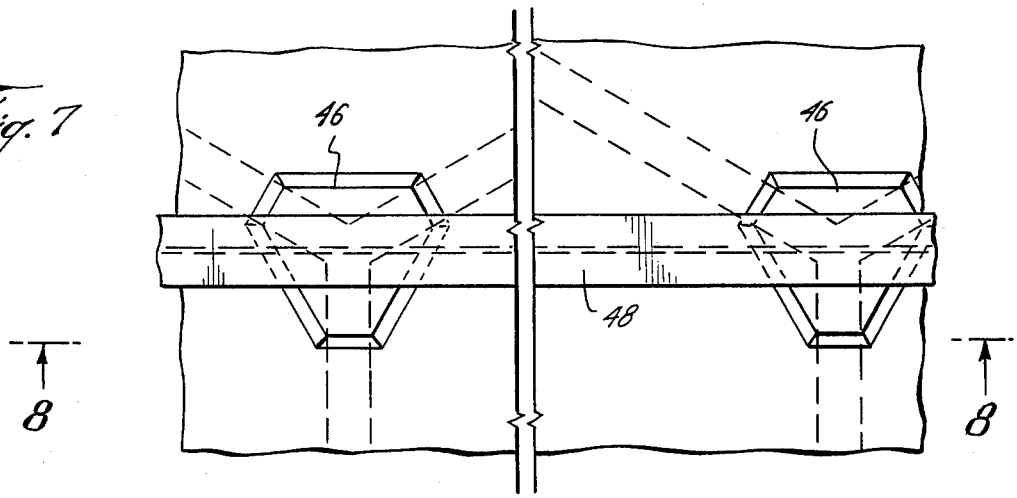
FIG. 7 is a partial plan view of a portion of the top slab of the structure according to the present invention showing interior structural details.
Figure 8:
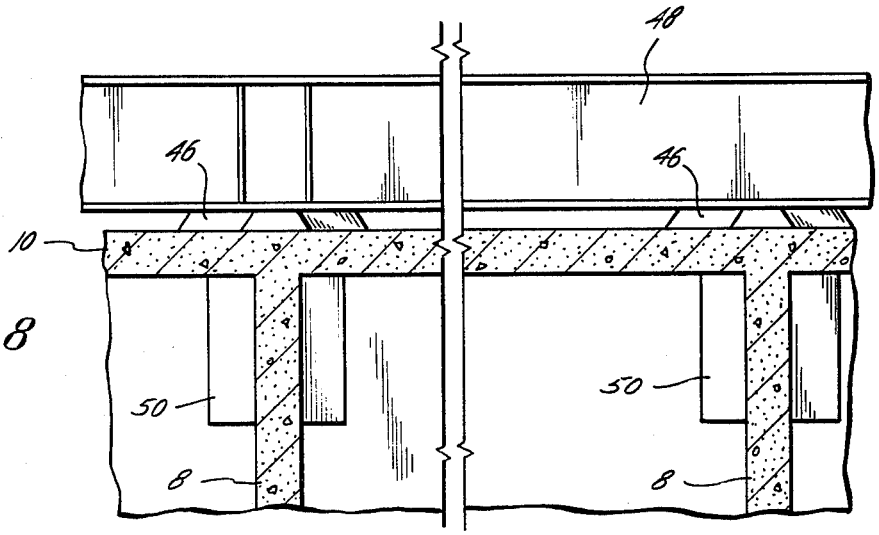
FIG. 8 is a vertical sectional view of the portion of the structure of the present invention shown in FIG. 7 taken on section line 8—8.

Drilling, production, process or other equipment 44 (FIGS. 1 and 2) is accommodated on top slab 10 of the structure 1 and also within selected cells formed of interior walls 8 of the structure 1 if required. Top slab 10 is designed to withstand moderate loading from the equipment placed directly upon its surface. For carrying heavier loads, the slab 10 is provided with beam bearing pads 46 directly above the intersection of interior cell walls 8 as shown in FIGS. 7 and 8. Steel skid beams 48 (FIG. 8) are mounted upon beam pads 46 above slab 10 for carrying heavier loads such as the deck houses and heavy equipment so that these heavier loads are distributed directly to the cell walls. As a further means for diffusing stress, pilasters 50 may be formed at the upper extremity of the intersection of cell walls 8 immediately below slab 10. Pilasters 50 are adapted to distribute point stress into compressive loads down vertical interior walls 8.

The marine structure of the present invention is adapted to function in water depths greater than approximately twenty feet. A structure 1 may be designed to serve in a range of water depths, and if the upper end of this prescribed range is exceeded, the same structure 1 may be used in deeper water by installing it on a prepared gravel berm placed upon the sea bottom. By way of illustration, a structure 1 designed for a water depth range of thirty feet to sixty feet, a total horizontal ice load of one-hundred sixty thousand kips and a maximum contact pressure of one thousand pounds per square inch may have a maximum base dimension of four hundred feet and an overall height to top of deck of ninety feet. Deflector 20 may extend from the top of the deck an additional twenty feet. Base slab 6 would be approximately two feet thick and the cell wall thickness could range from as little as nine inches to as much as five feet. Approximately sixteen thousand kips of top side equipment and supplies could be installed on the structure before it was transported to location. The total displacement would then be approximately one-hundred seventy five thousand kips with a light towing draft of approximately twenty eight feet when compressed air was introduced under the structure.

Groups of structures 1 may be assembled in modular fashion to permit staged development of an offshore oil and gas rig or other composite structure. Exploration drilling can be conducted from a single unit and after a discovery has been made the same unit can be used for production drilling purposes. Additional units may be fabricated and fitted out for the production, storage and transport functions while development drilling is in progress. These may be brought in at a late stage and installed adjacent to the drilling unit as shown in FIG. 6. The same basic structure configuration may be used for each unit. Individual structures 1 are large enough to permit most of the equipment to be installed prior to delivery of the units to the arctic or sub-arctic regions, and installation requirements between units will be therefore limited.

The foregoing disclosure and description of the invention are illustrative and explanatory thereof, and various changes in the size, shape and materials, as well as in the details of the illustrated construction may be made without departing from the spirit of the invention.

We claim:

1. A stable marine platform structure for supporting plant or equipment for marine operations and of the type adapted to be supported on the sea bottom or other support surface, comprising:

a continuous base slab for engaging the sea bottom or other support surface;

an interior hexagonal cell structure formed of a plurality of vertically oriented inter-connected cell walls standing upon said base slab;

a substantially vertical perimeter wall adjoining the periphery of said interior cell structure and surmounting said base slab, said perimeter wall being formed of a plurality of inter-connected, arcuate wall segments and a plurality of vertically oriented, planar wall segments, said planar segments formed between the juncture of said arcuate segments and the perimetrical vertices of said interior hexagonal cell structure;

a horizontally oriented, continuous top slab supported upon the upper extremities of said interior cell structure and adjoining said perimeter wall, said top slab being adapted for supporting plant or equipment used in the marine operation.

2. The structure of claim 1, wherein said structure is formed of a cementitious material.

3. The structure of claim 1, further comprising:

a radial cellular extension formed about the base periphery of said structure said extension being of like construction as said structure but of lesser vertical height.

4. The structure of claim 3, wherein said cellular extension is formed having a inclined top slab depending from said perimeter wall of said structure to said perimeter wall of said cellular extension.

5. The structure of claim 1, wherein said entire structure is formed in the shape of a substantially regular hexagon.

6. The structure of claim 1, wherein said interior cell structure is adapted to receive ballast.

7. The structure of claim 6, wherein selected interior walls of said interior cell structure are provided with passageways for fluid communication between cells formed by said selected interior walls.

8. The structure of claim 1, further comprising a prepared granular berm below sea level for supporting said base slab of said structure.

9. The structure of claim 1, further including foundation drain means for accelerating consolidation of the support surface, said drain means comprising one or more conduits mounted within sleeves formed in selected interior cell walls and extending through said base slab, said conduits being adapted to protrude from said base slab to penetrate the sea bottom or other supporting surface.

10. The structure of claim 1, further comprising:

load bearing beam means mounted to said top slab for supporting heavy loads;

beam pad means, for mounting said beam means to said top slab, said pad means being formed integrally with said top slab so as to overlay a point of intersection of said interior cell walls.

11. The structure of claim 1, further comprising:

a hardened exterior skin means formed around said perimeter wall for resisting abrasion.

12. The structure of claim 1 wherein said interior cell structure is adapted for receiving plant or equipment for use in the marine operation.

13. The structure of claim 1, further comprising:

skirt means depending from said base slab for enhancing said structure's resistance to lateral displacement.

14. A stable marine platform structure for supporting plant or equipment for marine operations of the type supported on the sea bottom or other support surface, comprising two or more support structures, assembled at a single location, each of said structures comprising:

a continuous base slab for engaging the sea bottom or other support surface;

an interior hexagonal cell structure formed of a plurality of vertically oriented inter-connected cell walls standing upon said base slab;

a substantially vertical perimeter wall adjoining the periphery of said interior cell structure and surmounting said base slab, said perimeter wall being formed of a plurality of inter-connected, arcuate wall segments and a plurality of vertically oriented, radially extending, planar wall segments, said planar segments formed between the juncture of said arcuate segments and the perimetrical vertices of said interior hexagonal cell structure;

a horizontally oriented, continuous top slab supported upon the upper extremities of said interior cell structure and adjoining said perimeter wall, said top slab being adapted for supporting plant or equipment used in the marine operation.

15. The structure of claim 1, further comprising:

a deflector wall formed about the upper extremity of said perimeter wall for deflecting sea water, ice or other substances encountered in the marine environment and preventing them from coming aboard said top slab of the structure.

* * * * *

UNITED STATES PATENT AND TRADEMARK OFFICE

CERTIFICATE OF CORRECTION

PATENT NO. : 4,478,537

DATED : October 23, 1984

INVENTOR(S) : JAL N. BIRDY, DILIPKUMAR N. BHULA

It is certified that error appears in the above-identified patent and that said Letters Patent is hereby corrected as shown below:

In column 1, line 52, please delete "circular" and insert therefor --cellular--.

Signed and Sealed this

*Eleventh* Day of *June 1985*

[SEAL]

*Attest:*

DONALD J. QUIGG

*Attesting Officer*

*Acting Commissioner of Patents and Trademarks*